US012636545B2

(12) United States Patent
Pirscher

(10) Patent No.: US 12,636,545 B2
(45) Date of Patent: May 26, 2026

(54) BALANCE BASE FOR ROWING MACHINE

(71) Applicant: Andreas Pirscher, Freienwil (CH)

(72) Inventor: Andreas Pirscher, Freienwil (CH)

( * ) Notice: Subject to any disclaimer, the term of this patent is extended or adjusted under 35 U.S.C. 154(b) by 247 days.

(21) Appl. No.: 17/282,153

(22) PCT Filed: Sep. 23, 2019

(86) PCT No.: PCT/IB2019/058040
§ 371 (c)(1),
(2) Date: Apr. 1, 2021

(87) PCT Pub. No.: WO2020/070578
PCT Pub. Date: Apr. 9, 2020

(65) Prior Publication Data

US 2022/0001234 A1 Jan. 6, 2022

(30) Foreign Application Priority Data

Oct. 4, 2018 (CH) ..... 01215/18

(51) Int. Cl.
*A63B 22/16* (2006.01)
*A63B 22/00* (2006.01)
*A63B 69/06* (2006.01)

(52) U.S. Cl.
CPC ..... *A63B 22/16* (2013.01); *A63B 22/0076* (2013.01); *A63B 69/06* (2013.01);
(Continued)

(58) Field of Classification Search
CPC ..... A63B 22/0076–0089; A63B 69/06; A63B 2022/0079; A63B 2069/062;
(Continued)

(56) References Cited

U.S. PATENT DOCUMENTS 3,089,699 A * 5/1963 Flesch ..... A63G 13/04 472/113
4,650,181 A * 3/1987 Yang ..... A63B 22/0076 482/148
(Continued)

FOREIGN PATENT DOCUMENTS

DE 20 2007 012 415 U1 1/2008
EP 0 340 525 A1 11/1989
(Continued)

OTHER PUBLICATIONS

Translation of FR2928092 (Year: 2009).*
International Search Report for International Application No. PCT/IB2019/058040 dated Dec. 3, 2019.

*Primary Examiner* — Loan B Jimenez
*Assistant Examiner* — Catrina A Letterman
(74) *Attorney, Agent, or Firm* — Greer, Burns & Crain, Ltd

(57) ABSTRACT

The invention relates to a balance base for a rowing machine. The base is used as a stand for the rowing machine, and the rowing machine can be positioned thereon in a fixed manner. At least one spring element is provided, wherein the at least one spring element is arranged between an upper frame and a lower frame, and the at least one spring element comprises an elastic or viscoelastic material, the tilting rigidity of which is both lower than the tensile-compressive rigidity of the spring and lower than the shear stiffness of the spring. Additionally, a form-fitting or force-fitting fixture of the upper frame to the rowing machine is provided.

24 Claims, 6 Drawing Sheets

(52) U.S. Cl.
CPC . *A63B 2022/0079* (2013.01); *A63B 2069/062* (2013.01); *A63B 2220/40* (2013.01); *A63B 2220/803* (2013.01); *A63B 2220/833* (2013.01)

(58) Field of Classification Search
CPC ..... A63B 2220/40; A63B 2220/803; A63B 2220/833; A63B 22/18; A63B 26/003; A63B 22/16–2022/185
See application file for complete search history.

(56) References Cited

U.S. PATENT DOCUMENTS

| | | | | |
|---|---|---|---|---|
| 7,438,672 | B1 * | 10/2008 | Rylander | A63B 22/0605 482/61 |
| 8,192,332 | B2 | 6/2012 | Baker et al. | |
| 2003/0166438 | A1 * | 9/2003 | Gramaccioni | A63B 26/003 482/72 |
| 2005/0164848 | A1 * | 7/2005 | Carbone | A63B 22/0076 482/142 |
| 2005/0170939 | A1 * | 8/2005 | Lin | A63B 26/003 482/121 |
| 2010/0190615 | A1 * | 7/2010 | Baker | A63B 69/06 482/73 |
| 2010/0288901 | A1 * | 11/2010 | Wallach | A63B 22/0076 248/346.03 |
| 2013/0225375 | A1 * | 8/2013 | Lumsden | A63B 21/0051 482/72 |
| 2015/0258366 | A1 * | 9/2015 | Domeika | A63B 22/0076 482/72 |
| 2017/0128773 | A1 | 5/2017 | Senk et al. | |
| 2019/0070476 | A1 * | 3/2019 | Bass | A63B 22/16 |
| 2021/0291012 | A1 * | 9/2021 | Fung | A63F 13/213 |

FOREIGN PATENT DOCUMENTS

| | | | | |
|---|---|---|---|---|
| FR | 2 928 092 | A1 | 9/2009 | |
| FR | 2928092 | * | 9/2009 | A63B 23/08 |
| KR | 10-2018-0080887 | A | 7/2018 | |

* cited by examiner

BALANCE BASE FOR ROWING MACHINE

CROSS-REFERENCE TO RELATED APPLICATIONS

This application is a National Stage application of International Patent Application No. PCT/IB2019/058040, filed on Sep. 23, 2019, which claims priority to Swiss Patent Application No. CH 01215/18, filed on Oct. 4, 2018, each of which is hereby incorporated by reference in its entirety.

TECHNICAL HELD OF THE INVENTION

The invention relates to a balance base for a rowing machine for training deep muscles.

BACKGROUND OF THE INVENTION

A rowing machine is used to perform a total body workout. A conventional rowing machine consists of a rigid frame with at least two feet, which are placed on the floor. The user slides longitudinally relative to the frame on a sliding seat while pulling on a pull strap or chain by means of a handle, which are connected to a braking resistance system via pulleys. Conventional rowing machines, which are placed directly on the floor, allow a guided movement of the user in longitudinal direction relative to the frame of the rowing machine. This guided movement in the longitudinal direction of the rowing machine is referred to as the sliding degree of freedom. The frame of the rowing machine is not movable relative to the floor.

On such conventional rowing machines you can train the main muscles, but less the deep muscles of the body center. The deep muscles of the body center can be trained by placing the rowing machine on a balance base, for example.

Balance bases for rowing machines are known. For example, U.S. Pat. No. 8,192,332 B2 describes an energy-absorbing base for use with a rowing machine. A spring element is disclosed, which consists of an elastomer or a spring and which allows the rower to move in all directions and thus has all degrees of freedom. However, this leads to a very complex training for users and is not suitable for beginners. In addition, the fatigue resistance of the rowing machine is compromised when the base allows movement in all directions.

U.S. Pat. No. 7,438,672 B1 describes a base for a bicycle ergometer which allows only lateral tilting movements. Movements in other directions are prevented by an additional pivot bearing element, which makes the design significantly complex and expensive.

US210288901A1 describes a base for a bicycle ergometer in which forward and backward movements are possible in addition to tilting movements. Therefore, the base is less suitable for a rowing machine. An upward and downward movement is prevented here by an additional arc-shaped bearing element.

From U.S. Pat. No. 4,650,181 a rowing training device is known, which is placed on springs to simulate the movements of a boat in the water. Again, the movement is possible in ail directions and the device is not suitable for beginners.

EP1340525 discloses a balance base for a rowing machine, which is designed, for example, as an arc spring and allows lateral rocking movements. The base is an integral part of the training device and cannot be transported separately from the rowing machine or used for different rowing machines.

DE202007012415U U1 describes a training device for balance exercises, which contains one or more acceleration sensors, speed sensors or inclination sensors.

SUMMARY OF THE INVENTION

The present invention now has the object of creating a balance base for rowing machines, which enables training of the deep muscles of the body center, which allows a targeted lateral tilting movement of the rowing machine, is suitable for use with various rowing machines, is easy to transport and easy to use.

DETAILED DESCRIPTION OF THE INVENTION

This object is solved by a balance base for a rowing machine, which serves as a stand for the rowing machine and on which the rowing machine can be fixedly positioned, wherein at least one spring element is provided, which is arranged between an upper frame and a lower frame. A form-fitting or force-fitting fixation for the upper frame with the rowing machine: is provided. The at least one spring element comprises an elastic or viscoelastic material whose tilting rigidity is both lower than the tensile-compressive rigidity and lower than the shear stiffness.

A rowing machine is a piece of sports equipment that can be used to simulate the movements of a rowing boat on land. It usually comprises, among other things, a rigid frame having at least two feet, a sliding seat which is movable in the longitudinal direction relative to the frame, and a handle which is attached to a pull strap or chain and is connected to a braking resistance system via deflection pulleys. As feet, the rowing machine may comprise at least two single feet in the front and two single feet in the rear or, alternatively, at least one wide foot in the front and at least one wide stand foot in the rear. Conventional rowing machines typically include one wide rear foot and one wide front foot or two rear feet and two front feet. To achieve a sufficiently good stability, the two rear feet or the two front feet are at least 10 cm apart, preferably at least 20 cm apart, even more preferably at least 30 cm apart. If the conventional rowing machine has only one wide rear foot and one wide front foot, the width of the rear foot or the front foot is at least 10 cm, preferably at least 20 cm, more preferably at least 30 cm. Conventional rowing machines are known, for example, under the names Concept2 or WaterRower. The rowing machine is not a subject matter of the invention.

The balance base according to the invention enables optimal training of the deep muscles of the body center. The deep muscles of the center of the body are best trained when a specific rotational movement of the rowing machine about its longitudinal axis, a so-called lateral tilting movement, is permitted. In order for the user to remain balanced, he must activate the deep muscles. For targeted training of the deep muscles, it is advantageous if, by placing the rowing machine on a balance base, no additional movements of the rowing machine, other than the lateral tilting movement, are possible and the rowing machine does not allow any further degrees of freedom of movement. This makes training on the rowing machine simpler and less complex, and is particularly advantageous when the deep muscles need to be trained without the intention of improving rowing technique for the rowing boat. This is achieved by the balance base according to the invention.

The at least one spring element disposed between an upper frame and a lower frame comprises an elastic or viscoelastic element or a mixture thereof, preferably a viscoelastic element.

In a particularly preferred embodiment, the at least one spring element is an elastomer, for example a round buffer. Depending on the desired elastic properties of the spring element, a softer elastomer with a hardness of 35 to 49 Shore A, a medium-soft elastomer with a hardness of 50 to 64 Shore A, or a hard elastomer with a hardness of 65 to 80 Shore A is selected. A soft elastomer allows a greater lateral tilting movement of the spring element and thus of the balance base or rowing machine, and thus a greater training effect of the deep muscles of the body center, which is applicable for advanced users. A hard elastomer allows smaller lateral tilting movements and leads to a smaller training effect, which is particularly suitable for beginners.

Preferably, the at least one spring element has a tilting rigidity which is lower than the tensile-compressive rigidity and the shear stiffness of the spring element by at least a factor of 25, preferably by at least a factor of 150, even more preferably by at least a factor of 300, particularly preferably by at least a factor of 600. The factor 25, as well as the factor 150, 300 or 600 respectively, refers to the numerical value of the rigidity under the assumption that the unit of the tensile-compressive rigidity and shear stiffness is given in Newton/meter and the unit of the tilting rigidity is given in Newton*meter. Tilting rigidity is understood as the resistance to rotational movement of the upper frame relative to the lower frame so that the upper frame is no longer arranged parallel to the lower frame, i.e. the rigidity of the tilting movement of the spring element. Tensile-compressive rigidity refers to the resistance to displacement of the upper frame relative to the lower frame in that, in the case of tensile rigidity, the upper frame is at a greater distance from the lower frame as a result of tension on the spring element than at rest, and in that, in the case of compressive rigidity, the upper frame is at a smaller distance from the lower frame as a result of pressure on the upper frame or on the spring element than at rest. The shear stiffness refers to the resistance to displacement of the upper frame relative to the lower frame, in which the upper frame is displaced laterally by shearing action on the upper frame or on the lower frame, but is still parallel to the lower frame. The desired properties of the rigidities of the spring element are achieved, for example, by an elastomer.

The at least one spring element may have any shape suitable for use as an intermediate element between an upper frame and a lower frame. Preferably, the at least one spring element has a cylindrical shape. However, it is also possible that the cylinder tapers or spreads upwards or downwards, or that the spring element has, for example, the shape of a cuboid or cube.

The at least one spring element preferably has a height between 10 mm and 100 mm, preferably between 30 mm and 70 mm, even more preferably between 40 mm and 50 mm. The diameter is between 5 mm and 150 mm, preferably between 30 mm and 100 mm, even more preferably between 50 mm and 80 mm.

In a preferred version, the at least one spring element is replaceable and detachably connected to the lower frame and the upper frame for this purpose. Preferably, the at least one spring element is fastened to the lower frame and to the upper frame via at least one fastening means. Preferably, the fastening means is a screw or a clamp connection. In a further embodiment, the spring element is non-detachably connected to the lower frame and the upper frame, for example via an adhesive connection, welded connection or soldered connection. In this embodiment, the spring element is not replaceable.

Preferably, the balance base comprises a single spring element positioned in the center of the balance base and as dose as possible to the geometric center of the upper frame and the lower frame. Preferably, the rowing machine is positioned on the balance base when used on the balance base such that the at least one, preferably the one spring element is arranged along the central longitudinal axis of the rowing machine.

The at least one upper frame and the at least one lower frame are preferably formed as a plate, preferably as a rectangular plate having a longitudinal side and a transverse site. Preferably, the plate is made of a resistant, lightweight material, preferably wood or plastic. Particularly preferably, the upper frame, and the lower frame respectively, is formed as a rectangular wooden plate. Preferably, the upper frame and the lower frame have the same size. Preferably, the upper frame has a recess for receiving a wide foot, or two recesses for receiving two feet of the rowing machine. If the upper frame has one recess for receiving a wide foot, the width of the upper frame, or the long side of the upper frame respectively, is slightly wider than the width of the wide foot. If the upper frame has two recesses for accommodating two feet of the rowing machine, the width of the upper frame, or the longitudinal side of the upper frame respectively, is slightly wider than the outer distance between the two feet.

In the resting state of the balance base, the upper frame is arranged parallel to the lower frame. In the training state, depending on the weight shift of the user of the rowing machine, a lateral tilting movement of the balance base is triggered, which reduces the distance between the upper frame and the base on one side and increases it on the other side.

The balance base according to the invention is designed in such a way that a rowing machine can be fixedly positioned on it. In particular, the rowing machine can be fixedly positioned on the upper frame of the balance base. The term fixedly positionable means that the rowing machine does not slip during training and is held in position on the balance base. This is achieved by providing a form-fitting or force-fitting fixation, or a combination thereof, for the upper frame with the rowing machine.

A form-fitting fixation is understood to be a connection of two elements, wherein the elements to be connected have an opposing shape, for example bolts, pins or keys and the corresponding counterparts thereto, so that movement of the two parts against each other is not possible and, as a result, forces can be transmitted from one to the other. Such a fixation is releasable.

Force-fitting fixation is understood to mean a fixation in which a force field is built up during use that enables force transmission. Examples of this are screw fasteners, clamp connections, fastening straps or plastic elements which create a sufficiently large frictional resistance between the upper frame of the balance base and the rowing machine so that the rowing machine can be fixedly fixed to the balance base and cannot slip.

In a particularly preferred embodiment, the fixation for the upper frame with the rowing machine is a form-fitting fixation and is designed as a recess in the upper frame for receiving one or more individual feet of the rowing machine. The recess preferably has substantially the shape of the outline of the feet of a rowing machine. When the rowing machine is placed with the feet on the balance base, the feet fill the recess in a substantially form-fitting manner. This results in a form-fitting fixation so that the rowing machine cannot slip during training.

If the balance base serves as a stand for a rowing machine which has two rear feet and two front feet, the distance between the two centers of the two recesses for receiving the two rear feet and the two front feet respectively is at least 10 cm, preferably at least 20 cm, even more preferably at least 30 cm. If the balance base serves as a stand for a rowing machine which has only one wide rear foot and one wide front foot, the width of the recess for accommodating the wide rear foot or the wide front foot is at least 10 cm, preferably at least 20 cm, even more preferably at least 30 cm. In a further embodiment, the fixation for the upper frame with the rowing machine is a force-fitting fixation and is designed as a fastening strap, fastening lever, quick-release fastener, damp connection or screw fastener. The force-fitting fixation can also be made of a non-slip plastic material and be designed, for example, as a rubber plate.

Preferably, the balance base serves as a stand for at least one wide rear foot of the rowing machine for two rear feet. If the roving machine comprises only one rear foot and only one front foot, the rear foot or the front foot must have a sufficiently large width for the rowing machine to stand stably. When the rear feet of the rowing machine are placed on the balance base according to the invention, the rowing machine can be rotated around the longitudinal axis of the rowing machine. Thus, a lateral tilting movement can take place. A forward or backward tilting movement of the rowing machine and thus a rotation about the transverse axis of the rowing machine is not possible in this embodiment.

In a further embodiment, the balance base serves as a stand for at least one wide front foot, preferably for two front feet of the rowing machine. If the balance base serves only as a stand for the front feet of the rowing machine, but not as a stand for the rear feet, a smaller lateral tilting movement is possible. This version can be used especially for training for beginners.

In a particularly preferred embodiment, the balance base for rowing machines comprises a first balance base component that includes a first spring element between a first lower frame portion and a first upper frame portion and serves as a stand for one or more rear feet of the ergometer, and a second balance base component which comprises a second spring element between a second lower frame portion and a second upper frame portion and serves as a stand for one or more front feet of the machine. This arrangement allows a greater lateral tilting movement of the rowing machine than if the balance base is placed only under the rear or front feet. Thus, a greater training effect is achievable.

In another preferred embodiment, the upper frame extends at least over the length between the rear feet and front feet of the rowing machine and serves as a stand for all feet of the rowing machine. In this embodiment, the balance base includes at least two spring elements, wherein a first spring element is positionable under the rear feet of the rowing machine and wherein a second spring element is positionable under the front feet of the rowing machine. The lower frame may also extend over the entire length between the rear feet and front feet of the rowing machine, or the balance base may have two bases, wherein a first base is connectable to the first spring element, and the second base is connectable to the second spring element. In this arrangement, too, a greater lateral tilting movement of the rowing machine is possible than if the balance base is placed only under the rear or front feet.

In a further embodiment, the balance base additionally comprises a motion or acceleration sensor for measuring the tilting motion of the upper frame relative to the lower frame, or for measuring the tilting motion of the rowing machine relative to the ground.

The balance base according to the invention has the additional advantage that it can be sold as an accessory independently of the rowing machine. This means that the user can use an existing commercially available rowing machine without reconfiguration and use the balance base to train the deep muscles as required. If no activation of the deep muscles is desired for a workout, the rowing machine can be used as usual without the balance base.

The balance base according to the invention is also suitable: for other training devices and can be used, for example, as a base for other ergometers such as paddle ergometers, running ergometers, bicycle ergometers, stair-climbing ergometers or cross-country skiing ergometers.

Further advantages of the invention follow from the following description, in which the invention is explained in more detail with reference to exemplary embodiments shown in the schematic drawings.

BRIEF DESCRIPTION OF THE DRAWINGS

The figures show as follows.

In the figures, the same reference numerals have been used for the same elements in each case, and first-time explanations apply to all figures unless expressly stated otherwise.

DESCRIPTION OF THE PREFERRED EMBODIMENTS

Figure 1:
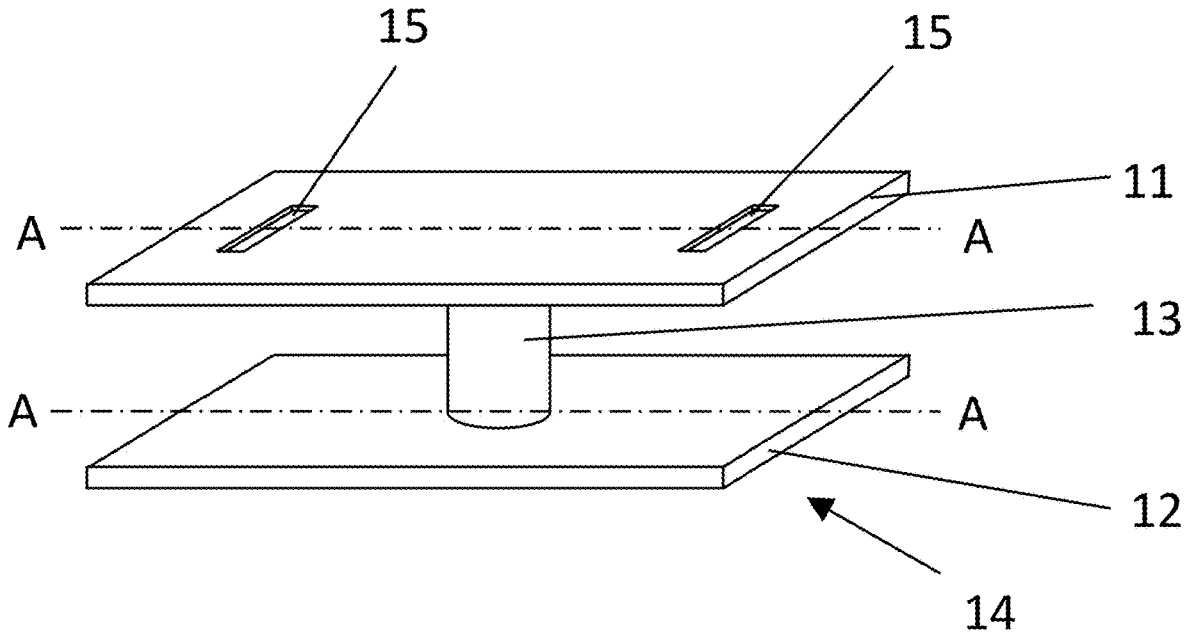
FIG. 1 shows a balance base according to the invention in perspective view obliquely from above.

FIG. 1 shows a balance base 14 according to the invention having an upper frame 11, a lower frame 12 and a spring element 13 arranged between the upper frame 11 and the louder frame 12. The upper frame 11 and the lower frame 12 have a rectangular shape with a longitudinal side and a transverse side. Two recesses 15 are provided in the upper frame 11 for accommodating two feet of a rowing machine (shown as numerals 2, 2', 2" in FIGS. 3 to 5). The two recesses 15 are arranged along the central longitudinal axis A-A of the upper frame 11 and at the same distance from the geometric center of the upper frame 11 and in the outer region of the longitudinal side of the upper frame 11. This ensures that the rowing machine (not shown, illustrated as numeral 1 in FIGS. 3 to 5) is horizontally balanced when at rest, when the rowing machine 1 is not being used as an exercise machine.

The recesses 15 essentially have the shape of the outline of the feet of a rowing machine. If the rowing machine is placed with the feet on the balance base 14, the feet fill the recesses 15 in a substantially form-fitting manner. This results in a form-fitting fixation so that the rowing machine cannot slip during training.

In the idle state, the upper frame 11 is arranged parallel to the lower frame 12, in this embodiment, the spring element 13 is shown as a cylindrical round buffer made of can elastomer. The spring element 13 is arranged at the geometric center of both the upper frame 11 and the lower frame 12.

Figure 2:
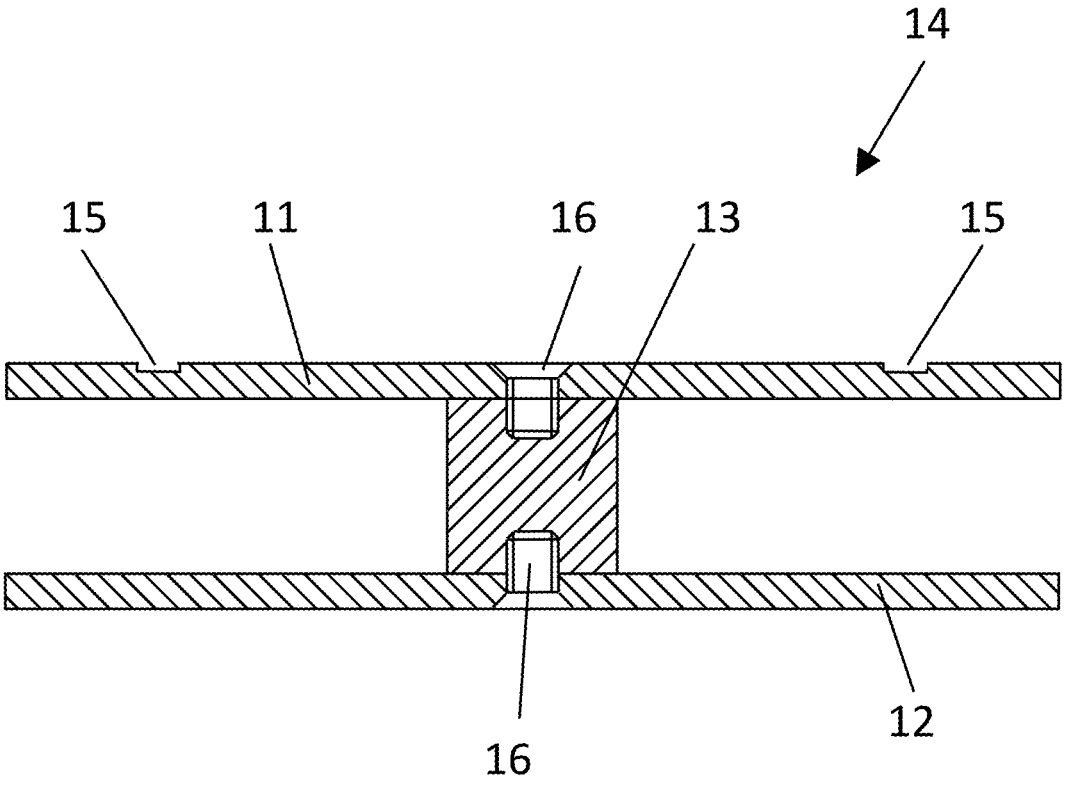
FIG. 2 shows a cross-section through the central longitudinal axes A-A of the balance base according to the invention of FIG. 1.

FIG. 2 shows a cross-section through the central longitudinal axis along lines A-A of the balance base 14 of FIG. 1. The upper frame 11 is arranged parallel to the lower frame 12 with a spring element 13 between them. The spring element 13 is laterally centered between the upper frame 11 and the lower frame 12 such that a first continuous lateral space is defined between the spring element 13 (e.g., left of the spring element) and a first laterally opposed edge (e.g., left edge) of the upper frame 11 and a second continuous lateral space is defined between the spring element 13 (e.g., right of the spring element) and a second laterally opposed edge (e.g., right edge) of the upper frame 11. The upper frame 11 has two recesses 15 for receiving two feet of a rowing machine (not shown). The recesses 15 are arranged in the outer region of the longitudinal side of the upper frame 11 at the same distance from the geometric center of the upper frame 11.

The spring element 13 is connected to the upper frame 11 and the lower frame 12 via two attachment means 16, shown here as screws. The spring element 13 is shown as a round buffer and is arranged in the geometric center of the upper frame 11 and the lower frame 12.

Figure 3:
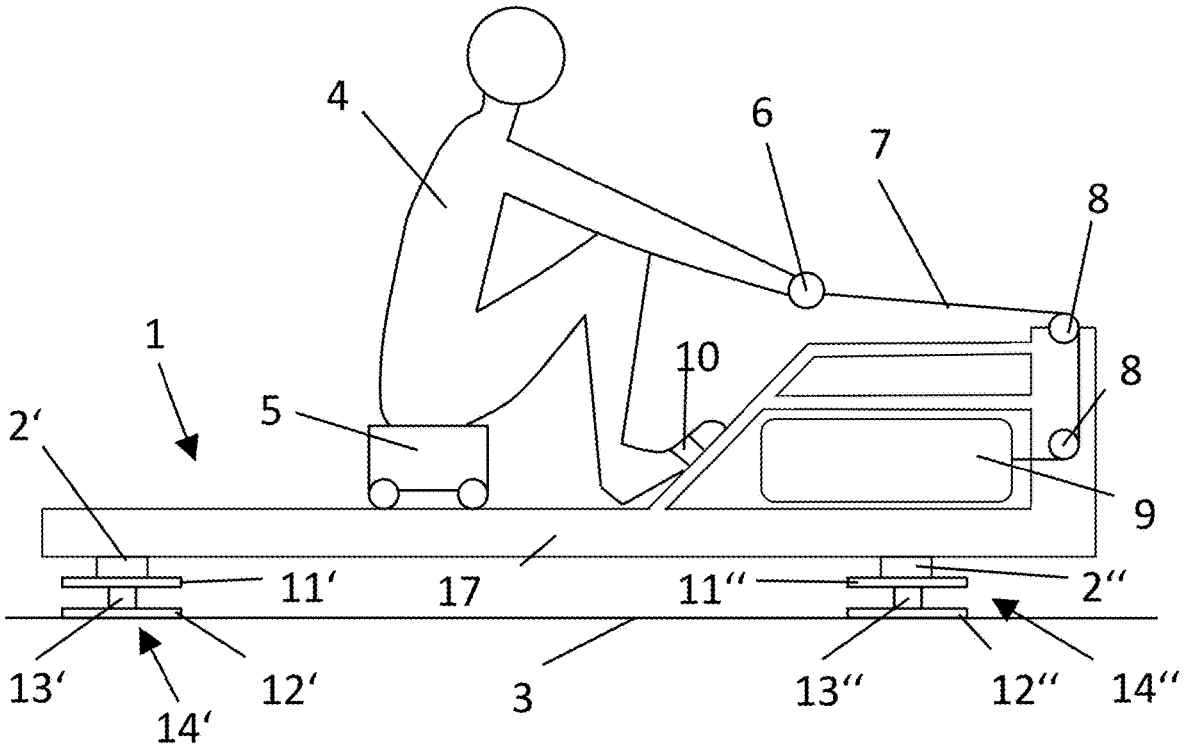
FIG. 3 shows a conventional rowing machine having first and second balance base components according to one embodiment of the invention in a side view.

FIG. 3 shows a conventional rowing machine 1, which is placed with the rear feet 2' on a first balance base component 14' and with the front feet 2" on a second balance base component 14", [which are] The components placed on a floor 3. The first balance base component 14' has a first spring element 13', which is arranged between a first upper frame portion 11' and a first lower frame portion 12'. The second balance base component 14" has a second spring element 13", which is arranged between a second upper frame portion 11" and a second lower frame portion 12".

The conventional rowing machine 1 has a frame 17 with standing feet, the rear feet 2' and the front feet 2". The user 4 sits on a sliding seat 5 that can be rolled in the longitudinal direction of the rowing machine 1 and relative to the frame 17 and pulls by means of a handle 6 on a pull strap or a pull chain 7, which are connected to a brake resistance system 9 via two deflection pulleys 8. The brake resistance system 9 is mounted in the frame 17 of the rowing machine 1. The user 4 is connected to the frame 17 by a foot support 10.

Figure 4:
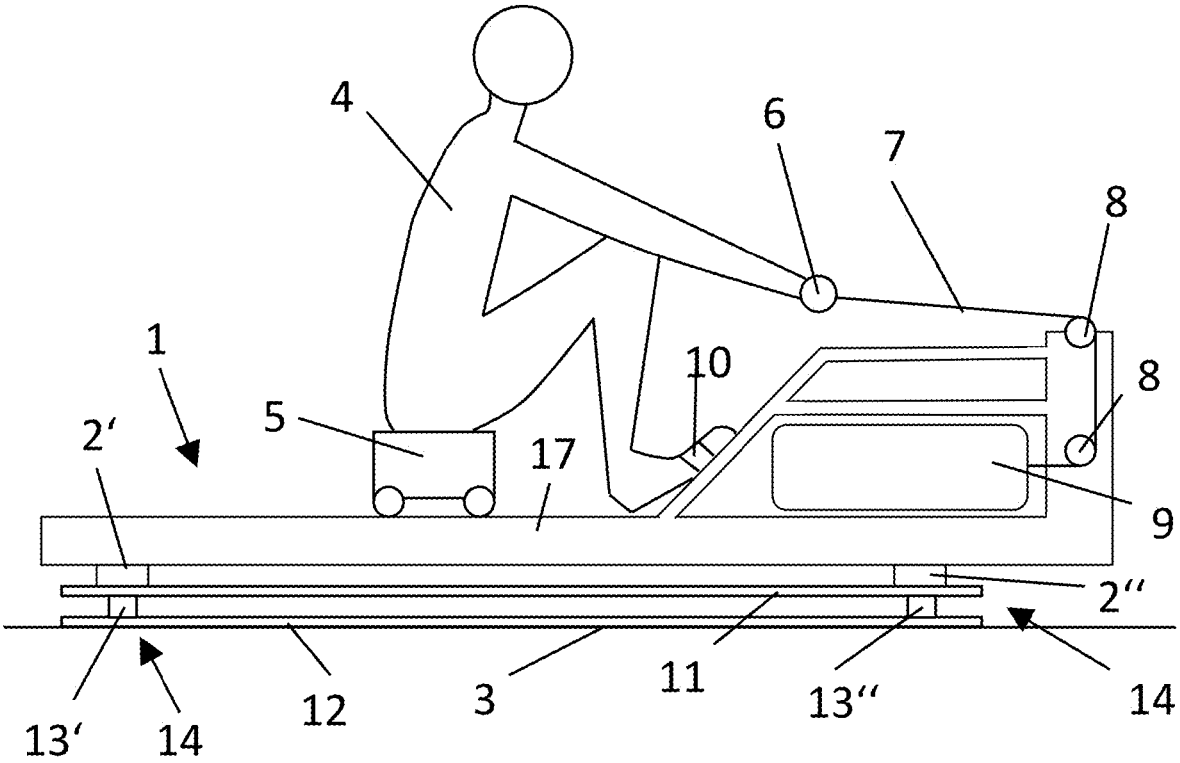
FIG. 4 shows a conventional rowing machine having a further balance base according to the invention in a side view.

FIG. 4 shows a conventional rowing machine 1 as described in FIG. 3, wherein instead of two balance base components only one balance base 14 is placed under the rowing machine 1 and serves as a stand for the rowing machine 1. The balance base 14 has an upper frame 11 and a lower frame 12, which extend over the entire length between the rear feet 2' and the front feet 2". In this variant, the upper frame 11 and the lower frame 12 are formed as large rectangular plates. The upper frame has two recesses for the rear feet 2' in the rear region of the plate and two recesses for the front feet 2" in the front region of the plate. A first spring element 13' is arranged substantially below the rear feet 2' between the upper frame 11 and the lower frame 12. A second spring element 13" is arranged substantially under the front feet 2" between the upper frame 11 and the lower frame 12.

Figure 5A:
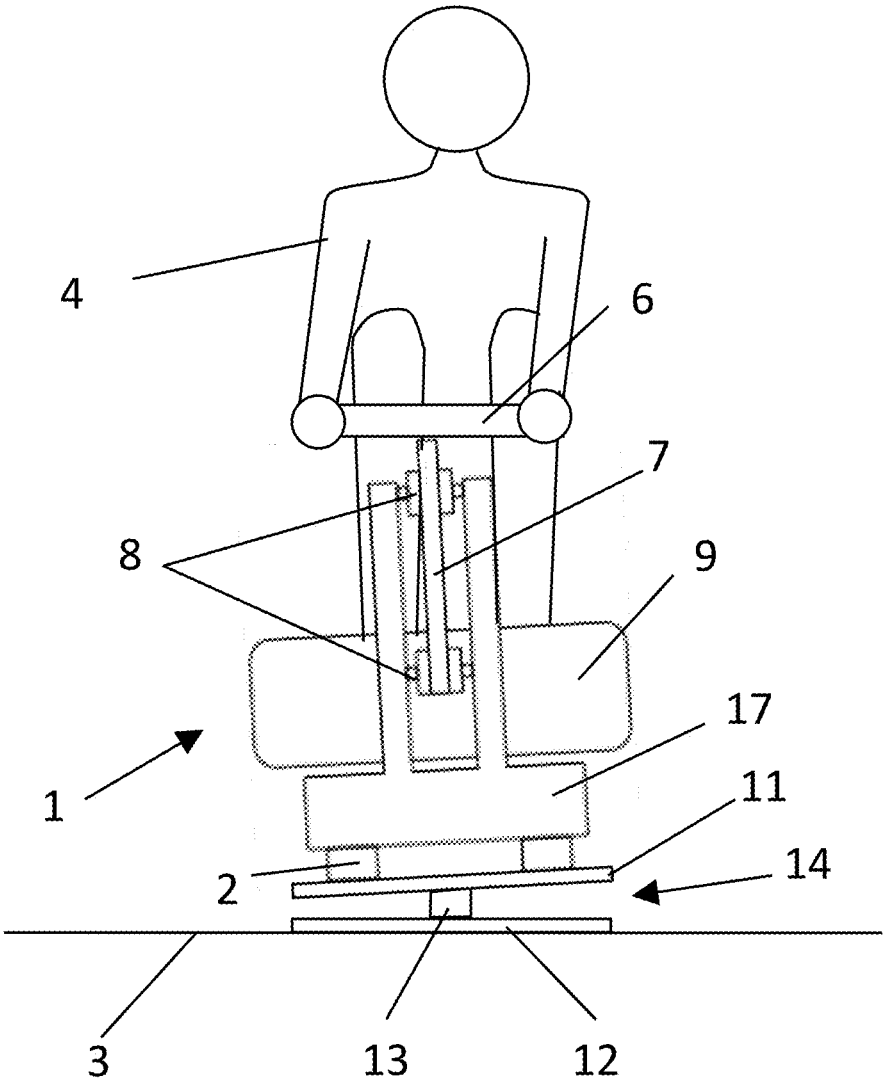
FIG. 5A shows a conventional rowing machine having the balance base according to the invention in a front view.

FIG. 5A shows a conventional rowing machine 1 with a balance base 14 according to the invention as described in FIGS. 3 and 4, but in front view and in a training situation with a slight lateral tilting tendency of the rowing machine 1. The upper frame 11 of the balance base 14 has a lateral tilting tendency, so that the distance between one transverse side of the upper frame 11 and the lower frame 12 or the floor 3 is lower than in the resting state or in the balanced state of the balance base 14, and so that the distance between the other transverse side of the upper frame 11 and the lower frame 12 or the floor 3 is greater than in the resting state or in the balanced state of the balance base 14.

Figure 5B:
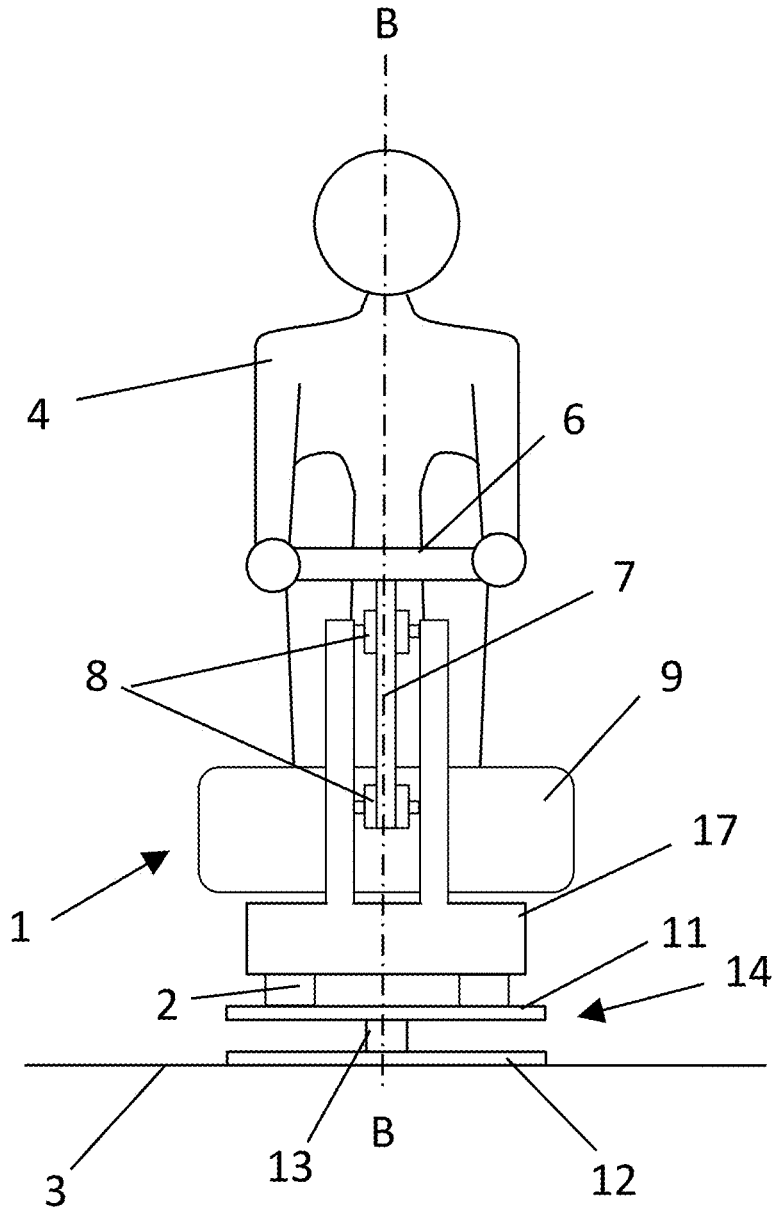
FIG. 5B shows a conventional rowing machine having the balance base according to the invention in a front view.

FIG. 5B shows a rowing machine 1 on the balance base 14 in front view as described in FIG. 5A, with the user sitting upright and balancing the rowing machine 1. In order for the user 4 to balance the rowing machine 1 and the upper frame 11 of the balance base 14, the user must activate the deep muscles of the center of the body. In the balanced state, the user's upper body, the rowing machine 1 and the spring element 13 of the balance base 14 are substantially aligned in a line, shown here as line B-B.

Although various embodiments of the present invention have been described and shown, the invention is not restricted thereto, but may also be embodied in other ways within the scope of the subject-matter defined in the following claims.

What is claimed is:

1. A balance base for a rowing machine, which is suitable as a stand for the rowing machine and on which the rowing machine can be fixedly positioned, wherein at least one spring element is provided, which is confined between an upper frame and a lower frame, wherein the upper frame has a length at least extending between front feet and rear feet of the rowing machine to serve as the stand for the rowing machine, and a form-fitting or force-fitting fixation is provided on the upper frame for the rowing machine, and wherein the at least one spring element is made of an elastic or viscoelastic material, wherein the at least one spring element is confined to a laterally centered region between the upper frame and the lower frame, wherein a lateral tilting rigidity of the at least one spring element is both lower than a tensile-compressive rigidity of the at least one spring element and lower than a shear stiffness of the at least one spring element, and wherein the balance base can be positioned under the rowing machine in such a manner that the at least one spring element is confined below the central longitudinal axis of the rowing machine, so that by placing the rowing machine on the balance base no additional movements of the rowing machine, other than the lateral tilting movement about the central longitudinal axis of the rowing machine, are possible.

2. The balance base according to claim 1, wherein the at least one spring element is an elastomer.

3. The balance base according to claim 2, wherein the lateral tilting rigidity is both lower than the tensile-compressive rigidity by at least a factor of 25 and lower than the shear stiffness by at least a factor of 25.

4. The balance base according to claim 2, wherein the lateral tilting rigidity is both lower than the tensile-compressive rigidity by at least a factor of 300 and lower than the shear stiffness by at least a factor of 300.

5. The balance base according to claim 2, wherein the lateral tilting rigidity is both lower than the tensile-compressive rigidity by at least a factor of 600 and lower than the shear stiffness by at least a factor of 600.

6. The balance base according to claim 2, wherein the form-fitting or force-fitting fixation for the upper frame with the rowing machine is formed as a recess in the upper frame for receiving feet of the rowing machine.

7. The balance base according to claim 1, wherein the lateral tilting rigidity is both lower than the tensile-compressive rigidity by at least a factor of 25 and lower than the shear stiffness by at least a factor of 25.

8. The balance base according to claim 7, wherein the form-fitting or force-fitting fixation for the upper frame with the rowing machine is formed as a recess in the upper frame for receiving feet of the rowing machine.

9. The balance base according to claim 1, wherein the lateral tilting rigidity is both lower than the tensile-compressive rigidity by at least a factor of 300 and lower than the shear stiffness by at least a factor of 300.

10. The balance base according to claim 9, wherein the form-fitting or force-fitting fixation for the upper frame with the rowing machine is formed as a recess in the upper frame for receiving feet of the rowing machine.

11. The balance base according to claim 1, wherein the lateral tilting rigidity is both lower than the tensile-compressive rigidity by at least a factor of 600 and lower than the shear stiffness by at least a factor of 600.

12. The balance base according to claim 1, wherein the form-fitting or force-fitting fixation for the upper frame with the rowing machine is formed as a recess in the upper frame for receiving feet of the rowing machine.

13. The balance base according to claim 1, wherein the first spring element is arranged in a center of the front portion of the upper frame and a center of the front portion of the lower frame, and the second spring element is arranged in a center of the rear portion of the upper frame and a center of the rear portion of the lower frame.

14. The balance base according to claim 1, wherein the at least one spring element is attached to the upper frame and to the lower frame via at least one screw or clamp connection.

15. The balance base according to claim 1, wherein the balance base comprises a motion or acceleration sensor for measuring a tilting motion of the upper frame relative to the lower frame.

16. A balance base having a longitudinal and lateral direction and suitable as a stationary stand on which a rowing machine can be supported in alignment with the longitudinal direction comprising:

a first balance base component having a first upper frame portion with a form-fitting or force-fitting fixation that serves for securing rear feet of the rowing machine, and a first lower frame portion connected with the first upper frame portion by a single first spring element connected to both the first lower upper frame portion and the first lower frame portion, the first upper frame portion having first and second laterally opposed edges, the form-fitting or force-fitting fixation being disposed such that the rear feet of the rowing machine when secured are longitudinally aligned with the first spring element, wherein no element disposed between the upper frame portion of the first balance base component and the lower frame portion of the first balance base component other than the first spring element provides resilient restraint to the lateral tilting of the rowing machine on the first balance base component;

a second balance base component spaced longitudinally from the first balance base component and having a second upper frame portion with a form-fitting or force-fitting fixation that serves for securing front feet of the rowing machine, and a second lower frame portion connected with the second upper frame portion by a single second spring element connected to both the second lower upper frame portion and the second lower frame portion, the second upper frame portion having first and second laterally opposed edges, the form-fitting or force-fitting fixation being disposed such that the front feet of the rowing machine when secured are longitudinally aligned with the second spring element, wherein no element disposed between the upper frame portion of the second balance base component and the lower frame portion of the second balance base component other than the second spring element provides resilient restraint to the lateral tilting of the rowing machine on the second balance base component;

the first spring element being made of an elastic or viscoelastic material and being confined between the first upper frame portion and the first lower frame portion in a laterally centered position of the first balance base component, wherein a first continuous lateral space extends from the first spring element to the first laterally opposed edge of the first upper frame portion and longitudinally along the entire length of the first spring element and a second continuous lateral space extends from the first spring element to the second laterally opposed edge of the first upper frame portion and longitudinally along the entire length of the first spring element, the first spring element providing resilient restraint to lateral tilting of the rowing machine on the first balance base component;

the second spring element being made of an elastic or viscoelastic material and being confined between the second upper frame portion and the second lower frame portion in a laterally centered position of the second balance base component, wherein a first continuous lateral space extends from the second spring element to the first laterally opposed edge of the second upper frame portion and longitudinally along the entire length of the second spring element and a second continuous lateral space extends from the second spring element to the second laterally opposed edge of the second upper frame portion and longitudinally along the entire length of the second spring element, the second spring element providing resilient restraint to lateral tilting of the rowing machine on the second balance base component.

17. The balance base according to claim 16, wherein the first spring element and the second spring element are elastomers, and wherein, for each of the first spring element and the second spring element, a tilting rigidity is both lower than a tensile-compressive rigidity by at least a factor of 25 and lower than a shear stiffness by at least a factor of 25.

18. The balance base according to claim 17, wherein the first spring element and the second spring element are each formed as a cylinder, a cuboid, or a cube.

19. The balance base according to claim 16, wherein the first spring element is disposed in a geometric center of the first balance base component; and wherein the second spring element is disposed in a geometric center of the second balance base component.

20. A balance base having a longitudinal and lateral direction and suitable as a stationary stand on which a rowing machine can be supported in alignment with the longitudinal direction comprising:

a first balance base component having an upper frame portion with a form-fitting or force-fitting fixation that serves for securing rear feet of the rowing machine, and a corresponding lower frame portion, the upper frame portion of the first balance base component having first and second laterally opposed edges;

a second balance base component spaced longitudinally from the first balance base component and having an upper frame portion with a form-fitting or force-fitting fixation that serves for securing front feet of the rowing machine, and a corresponding lower frame portion, the upper frame portion of the second balance base component having first and second laterally opposed edges;

the first balance base component having a laterally centered first spring element made of an elastic or viscoelastic material confined between the upper frame portion and the corresponding lower frame portion of the first balance base component in a laterally centered position of the first balance base component and connected to both the upper frame portion and the corresponding lower frame portion of the first balance base component, wherein a first continuous lateral space extends from the laterally centered first spring element to the first laterally opposed edge of the upper frame portion of the first balance base component and longitudinally along the entire length of the first spring element and a second continuous lateral space extends from the laterally centered first spring element to the second laterally opposed edge of the upper frame portion of the first balance base component and longitudinally along the entire length of the first spring element, the first spring element providing resilient restraint to lateral tilting of the rowing machine on the first balance base component, wherein no element disposed between the upper frame portion of the first balance base component and the lower frame portion of the first balance base component other than the laterally centered first spring element provides resilient restraint to the lateral tilting of the rowing machine on the first balance base component; and the second balance base component having a laterally centered second spring element made of an elastic or viscoelastic material confined between the upper frame portion and the corresponding lower frame portion of the second balance base component in a laterally centered position of the second balance base component and connected to both the upper frame portion and the corresponding lower frame portion of the second balance base component, wherein a first continuous lateral space extends from the laterally centered second spring element to the first laterally opposed edge of the upper frame portion of the second balance base component and longitudinally along the entire length of the second spring element and a second continuous lateral space extends from the laterally centered second spring element to the second laterally opposed edge of the upper frame portion of the second balance base component and longitudinally along the entire length of the second spring element, the second spring element providing resilient restraint to lateral tilting of the rowing machine on the second balance base component, wherein no element disposed between the upper frame portion of the second balance base component and the lower frame portion of the second balance base component other than the laterally centered second spring element provides resilient restraint to the lateral tilting of the rowing machine on the second balance base component.

21. The balance base according to claim 20, wherein, for the first balance base component, the first continuous lateral space and the second continuous lateral space extend vertically from the upper frame portion of the first balance base component to the lower frame portion of the first balance base component, wherein for the second balance base component, the first continuous lateral space and the second continuous lateral space extend vertically from the upper frame portion of the second balance base component to the lower frame portion of the second balance base component, and wherein the first spring element and the second spring element are elastomers.

22. The balance base according to claim 20, wherein, for the first balance base component, the first continuous lateral space and the second continuous lateral space are disposed at a vertical midpoint between the upper frame portion of the first balance base component and the lower frame portion of the first balance base component, and for the second balance base component, the first continuous lateral space and the second continuous lateral space are disposed at a vertical midpoint between the upper frame portion of the second balance base component and the lower frame portion of the second balance base component, and wherein the first spring element and the second spring element are elastomers.

23. The balance base according to claim 20, wherein the first spring element and the second spring element are elastomers, and wherein, for each of the first spring element and the second spring element, a tilting rigidity is both lower than a tensile-compressive rigidity by at least a factor of 25 and lower than a shear stiffness by at least a factor of 25.

24. A balance base on which a rowing machine can be mounted for physical training comprising:

an upper frame with a front portion adapted for connection to a front part of the rowing machine, and a rear portion adapted for connection to a rear part of the rowing machine;

a lower frame with a front portion disposed below the front portion of the upper frame and a rear portion disposed below the rear portion of the upper frame;

a first spring element positioned between the front portion of the upper frame and the front portion of the lower frame in a laterally centered position and providing resilient restraint to lateral tilting of the rowing machine on the balance base; and a second spring element positioned between the rear portion of the upper frame and the rear portion of the lower frame in a laterally centered position, and providing resilient restraint to the lateral tilting of the rowing machine on the balance base;

wherein the first spring element and the second spring element are each made from an elastic or viscoelastic material; and wherein no element disposed between the upper frame and the lower frame other than the first spring element and the second spring element provides resilient restraint to the lateral tilting of the rowing machine on the balance base.

* * * * *